US006719218B2

(12) United States Patent
Cool et al.

(10) Patent No.: US 6,719,218 B2
(45) Date of Patent: Apr. 13, 2004

(54) MULTIPLE DISCHARGE SHOWER HEAD WITH REVOLVING NOZZLE

(75) Inventors: Lonnie F. Cool, North Olmsted, OH (US); Mark S. Kacik, Strongsville, OH (US); Yaakov Korb, Cleveland Heights, OH (US); Richard A. Parso, Brunswick, OH (US); Stephen J. Zaborszki, Northfield Center, OH (US)

(73) Assignee: Moen Incorporated, North Olmsted, OH (US)

( * ) Notice: Subject to any disclaimer, the term of this patent is extended or adjusted under 35 U.S.C. 154(b) by 18 days.

(21) Appl. No.: 09/888,892

(22) Filed: Jun. 25, 2001

(65) Prior Publication Data

US 2003/0006304 A1 Jan. 9, 2003

(51) Int. Cl.[7] ..... A62C 31/00; B05B 3/02; B05B 3/04

(52) U.S. Cl. ..... 239/443; 239/440; 239/449; 239/222.11; 239/222.17

(58) Field of Search ..... 239/443, 449, 239/440, 462, 222.11, 222.15, 222.13, 222.17, 222.19, 223, 224, 380–383, 389, 237, 240, 255, 262

(56) References Cited

U.S. PATENT DOCUMENTS

| | | | | | |
|---|---|---|---|---|---|
| 3,091,400 | A | | 5/1963 | Aubert | |
| 3,094,254 | A | | 6/1963 | Cullen et al. | |
| 4,022,242 | A | * | 5/1977 | Turecek | 137/270 |
| 4,073,438 | A | | 2/1978 | Meyer | |
| 4,117,979 | A | | 10/1978 | Lagarelli et al. | |
| 4,802,628 | A | | 2/1989 | Dautel et al. | |
| 5,108,035 | A | | 4/1992 | Friedrichs | |
| 5,294,054 | A | * | 3/1994 | Benedict et al. | 239/222.15 |
| 5,372,307 | A | | 12/1994 | Sesser | |
| 5,381,960 | A | | 1/1995 | Sullivan et al. | |
| 5,439,174 | A | | 8/1995 | Sweet | |
| 5,588,595 | A | | 12/1996 | Sweet et al. | |
| 5,671,885 | A | | 9/1997 | Davisson | |
| 5,671,886 | A | | 9/1997 | Sesser | |
| 5,704,547 | A | | 1/1998 | Golan et al. | |
| 5,722,592 | A | | 3/1998 | Jager | |
| 5,950,927 | A | | 9/1999 | Elliott et al. | |
| 5,971,297 | A | | 10/1999 | Sesser | |
| 6,092,739 | A | * | 7/2000 | Clearman et al. | 239/237 |
| 6,199,771 | B1 | * | 3/2001 | Clearman et al. | 239/222.11 |
| 6,214,224 | B1 | * | 4/2001 | Farley | 210/282 |

* cited by examiner

*Primary Examiner*—Davis D Hwu
(74) *Attorney, Agent, or Firm*—Calfee, Halter & Griswold LLP

(57) ABSTRACT

A shower head has a housing with a water inlet and a control valve which connects to the housing inlet and has a plurality of water outlets. The control valve regulates the flow of water to a plurality of circumferentially arranged spray openings and to a nozzle which is located within the periphery of the spray openings. The nozzle has the ability to turn or spin, thus providing a soft spray which may be independent of or concurrent with the discharge of water from the spray openings. The nozzle may also wobble, which movement may be described as nutational, or the slow movement of the axis of the nozzle about another axis. Wobbling movement provides a somewhat more concentrated spray than that provided when the nozzle only spins. The shower head further has an auxiliary port which may be utilized with other spray devices such as fixed sprays or hand-held shower heads.

54 Claims, 15 Drawing Sheets

16
170
22
20
18
12
14
10
74
4
180
188
170
14
160
54
10
74
4

Fig. 6.
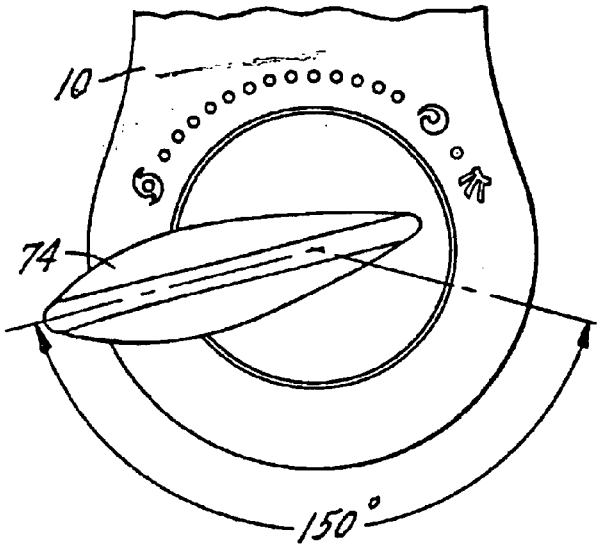
Fig. 7.
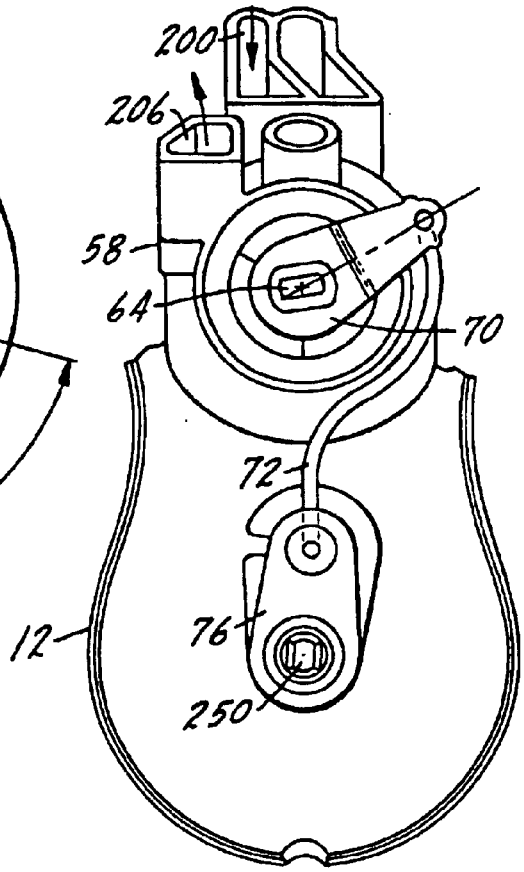
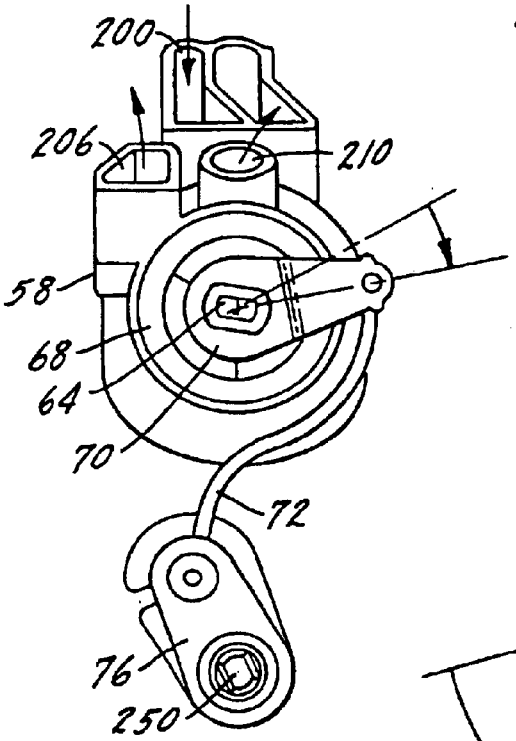
Fig. 10.
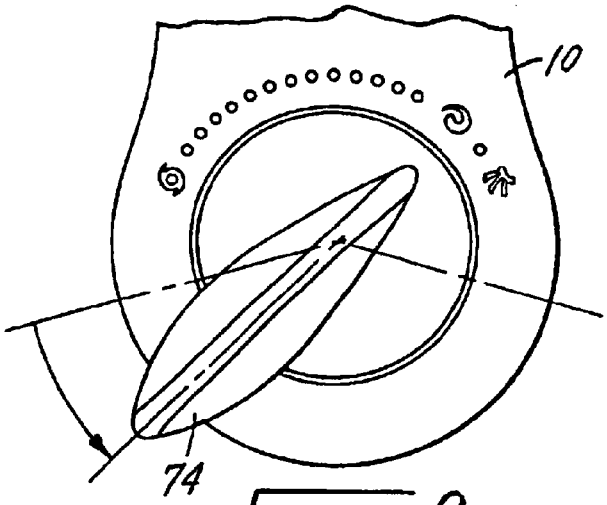
Fig. 9.

FULL HALO

Fig.11.
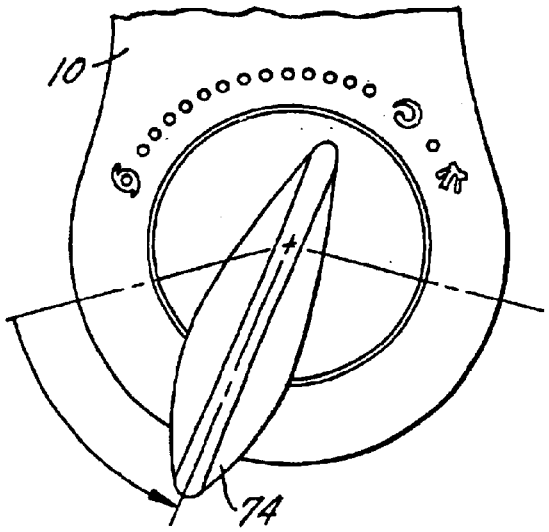
Fig.12.
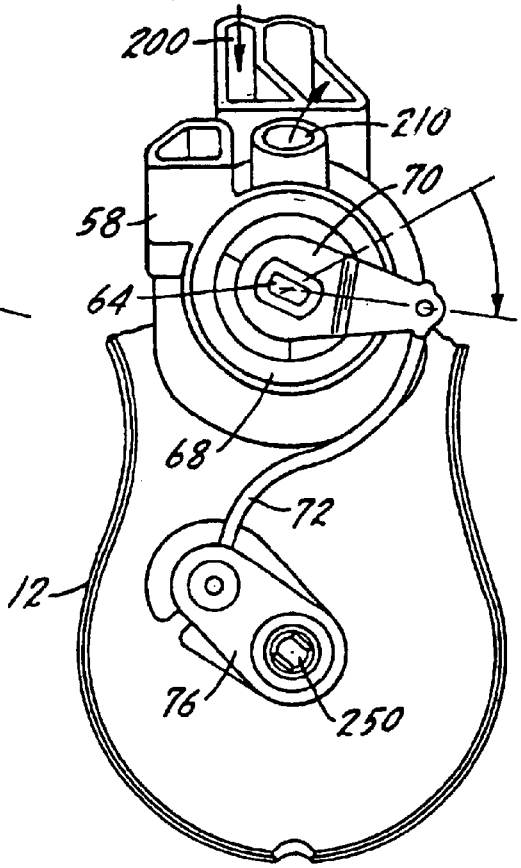
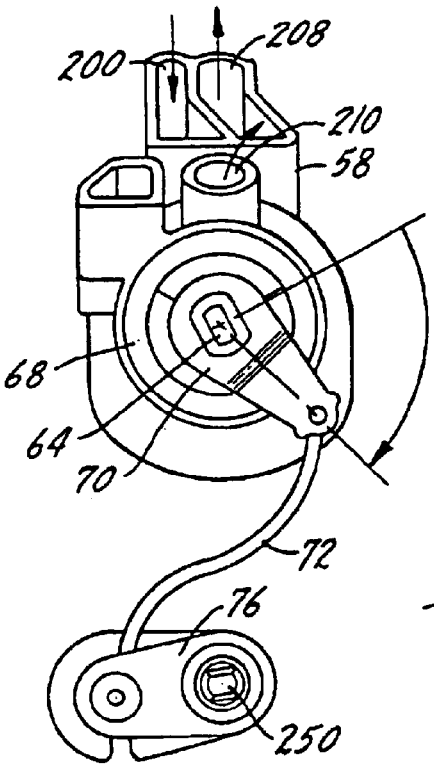
Fig.14.
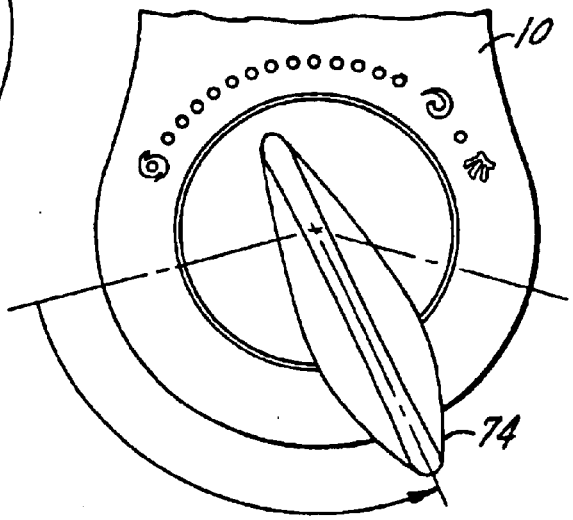
Fig.13.

Fig. 15.
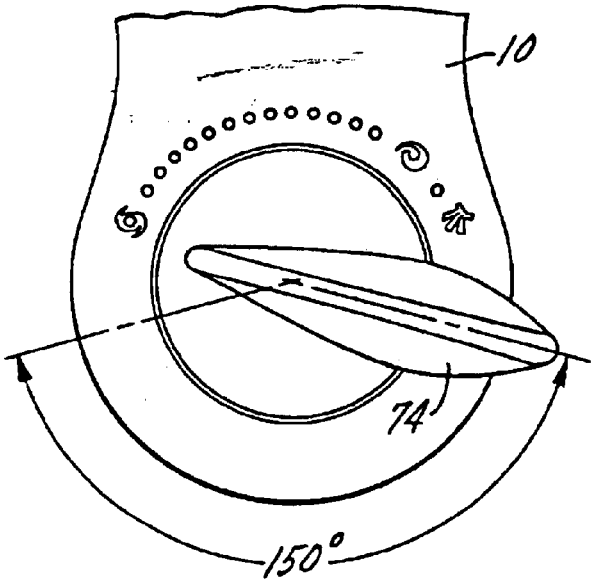
Fig. 15A.
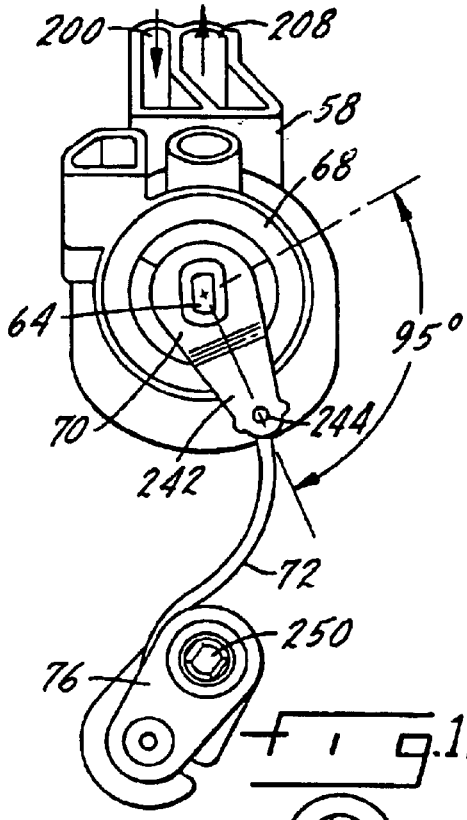
Fig. 16.
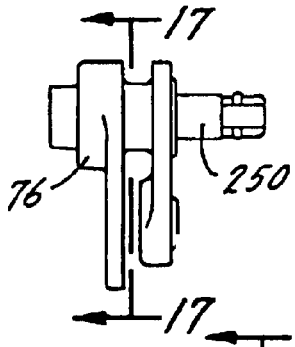
Fig. 17.
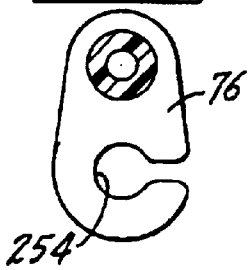
Fig. 18.
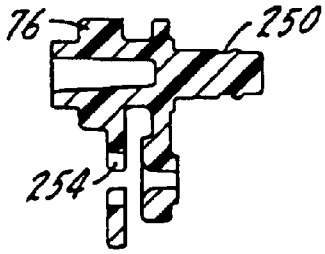
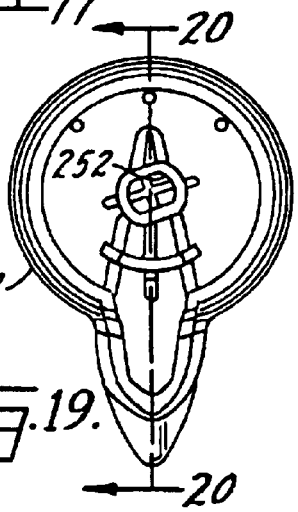
Fig. 19.
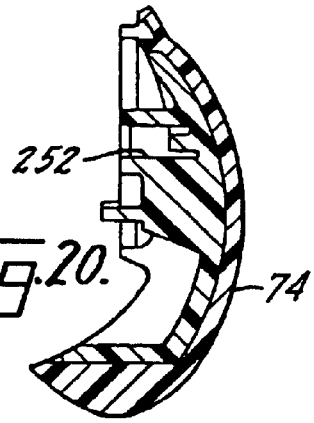
Fig. 20.

HALO & SPIN EQUAL

HALO OFF / MAX. SPIN

SPIN AND WOBBLE

WOBBLE ONLY

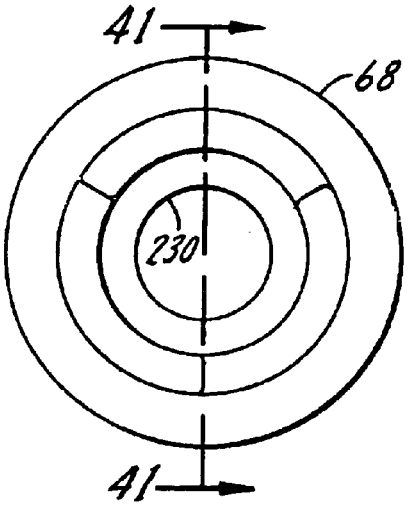
Fig.40.
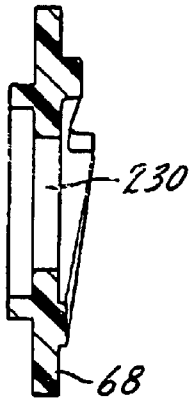
Fig.41.
Fig.42.
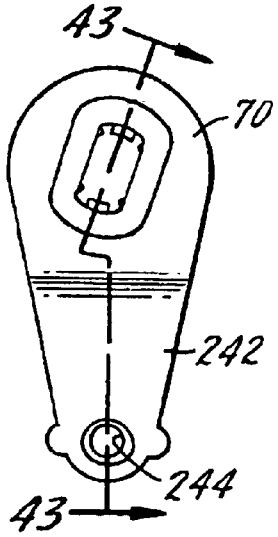
Fig.43.
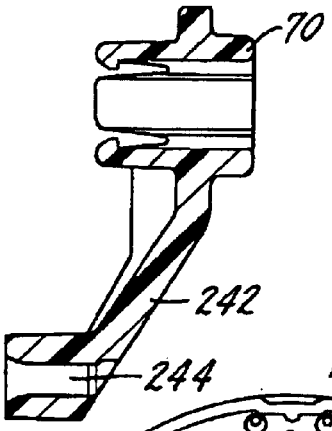
Fig.44.
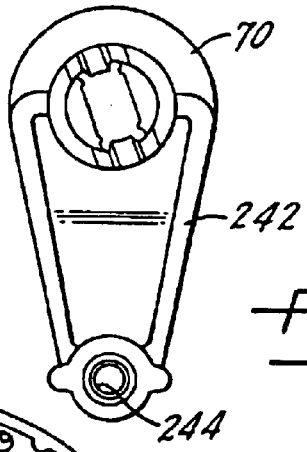
Fig.45.
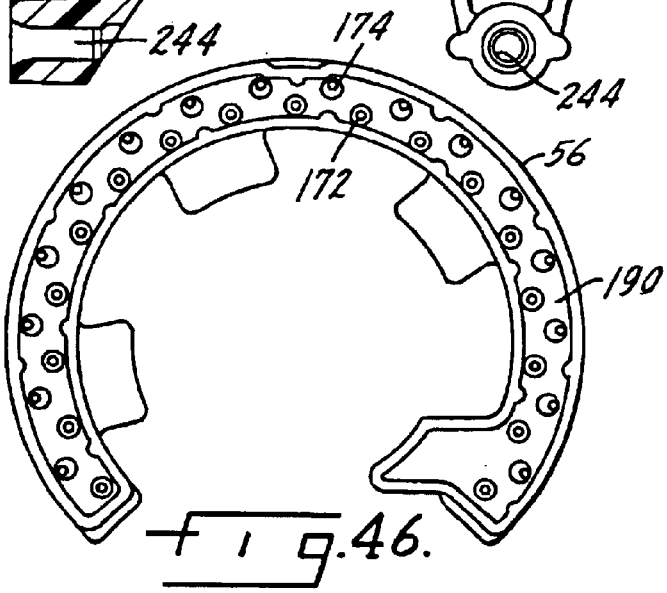
Fig.46.
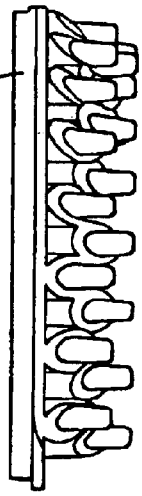

(SPIN MODE)

MULTIPLE DISCHARGE SHOWER HEAD WITH REVOLVING NOZZLE

THE FIELD OF THE INVENTION

The present invention relates to a shower head and more specifically to a shower head which may provide multiple different water spray patterns. The shower head may provide a conventional spray pattern essentially circumferential in configuration; it may provide a soft, partially focused spray resulting from a spinning nozzle; or it may provide a more focused direct spray, somewhat harder than that from the spinning nozzle, which is the result of a wobbling or nutational movement of the nozzle. The shower head may also provide a combination of the conventional spray pattern and partially focused spray, and a combination of the spinning and wobbling spray patterns.

U.S. Pat. No. 6,092,739, owned by Moen Incorporated of North Olmsted, Ohio, the assignee of the present application, describes and claims a spray head or shower head in which there is a turbine which creates a wobbling motion for the spray nozzle. The present invention advances the technology of the '739 patent to provide not only a wobbling or nutational movement of the shower head nozzle, but also a variable speed spinning movement of the spray nozzle, as well as a mixture of these two motions. The shower head further has an auxiliary port which may be normally closed, but which is adaptable for use with a separate hand-held shower head or to provide water for fixed sprays located around a shower enclosure.

The shower head includes a control valve which is effective to direct water from the shower head inlet through different water passages so as to provide the multiple spray patterns described above. In one position, all of the water is directed through the circumferentially arranged halo spray outlets. In a second position, the water is directed to a spin inducing member which is connected to the nozzle and which will cause the nozzle to spin with the resultant soft spray. The control valve permits mixing of these two spray patterns. In a third position, the control valve will direct water to a turbine, which will create a wobbling or nutational movement of the nozzle, providing a somewhat harder and more focused spray pattern. It is possible to mix the hard and soft spray patterns by permitting a degree of spinning movement as the nozzle wobbles.

The wobble inducing member and the spin inducing member are coaxially positioned within the shower head and each has separate water passages to direct incoming water into the chambers in which these elements move. Both are connected to the nozzle and both are effective to cause movement of the nozzle.

SUMMARY OF THE INVENTION

The present invention relates to a shower head having multiple spray patterns and in particular to such a shower head in which the spray pattern may result from a conventional fixed halo of spray outlets, from a spinning nozzle which provides a soft focused spray, or from a wobbling nozzle which provides a somewhat harder and more focused spray.

Another purpose of the invention is a shower head as described in which there is an auxiliary port which may be used to provide water to a hand-held shower or other additional shower spray devices fixed in a shower enclosure.

Another purpose of the invention is to provide a simply constructed, reliable shower head which can provide, at the user's control, multiple and different spray patterns.

Another purpose of the invention is to provide a shower head which creates different visual and sensorial shower experiences by providing control over a range of the water force, frequency and coverage.

Another purpose of the invention is to provide a shower head in which there may be a fixed spray pattern, or adjustable spray patterns, which may vary within certain parameters.

Another purpose of the invention is to provide a shower head having a spray pattern with varying force providing a massage-like feeling.

Another purpose of the invention is to provide a shower head in which the user, through simple hand operation, may vary the type of spray pattern provided by the shower head.

Another purpose is to provide a shower head which may have a soft rainlike high frequency spinning spray pattern or a spray pattern with increasing force which provides a kneading massage.

Another purpose is a shower head of the type described which may provide combinations of the described spray patterns.

Other purposes will appear in the ensuing specification, drawings and claims.

BRIEF DESCRIPTION OF THE DRAWINGS

The invention is illustrated diagrammatically in the following drawings wherein:

FIG. 6 is a partial front view showing the control knob in a full halo position;

FIG. 7 is a partial front view with a portion of the cover removed and illustrating valve position and water flow at the full halo position;

FIG. 9 is a partial front view showing the control knob in a halo/spin position;

FIG. 10 is a partial front view with a portion of the cover removed, similar to FIG. 7, illustrating valve position and water flow at a halo/spin position;

FIG. 11 is a partial front view showing the control knob in a spin position;

FIG. 12 is a partial front view with a portion of the cover removed, similar to FIGS. 7 and 10, illustrating valve position and water flow at the spin position;

FIG. 13 is a partial front view showing the control knob in a spin/wobble position;

FIG. 14 is a partial front view, with a portion of the cover removed, similar to FIGS. 7, 10 and 12, illustrating valve position and water flow at a spin/wobble position;

FIG. 15 is a partial front view showing the control knob in a wobble position;

FIG. 15A is a partial front view, with a portion of the cover removed, illustrating valve position and water flow at a wobble position;

FIG. 16 is a side view of the control knob linkage;

FIG. 17 is a section along plane 17—17 of FIG. 16;

FIG. 18 is an axial section through the control knob linkage;

FIG. 19 is a rear view of the control knob;

FIG. 20 is a section along plane 20—20 of FIG. 19;

FIG. 40 is a front view of the control valve weld plate;

FIG. 41 is a section along plane 41—41 of FIG. 40;

FIG. 42 is a front view of the valve stem linkage;

FIG. 43 is a section along plane 43—43 of FIG. 42;

FIG. 44 is a rear view of the valve stem linkage;

FIG. 45 is a side view of the spray face plate;

FIG. 46 is a rear view of the spray face plate;

DESCRIPTION OF THE PREFERRED EMBODIMENT

The present invention relates to a shower head which may provide multiple different spray patterns. There may be what is termed a "halo" spray pattern which derives from a plurality of circumferentially arranged spray openings, as in a conventional shower head. There is a spray nozzle which may spin, and which is located within the periphery of the spray openings and when it does spin, provides an adjustable, medium to wide, soft spray pattern. The nozzle may also wobble, in which case the nozzle spray is more focused and somewhat harder than that provided by pure spin movement of the nozzle. The control which provides the shower user with the ability to select the desired spray pattern also allows the user to combine the spray patterns from halo and spin and from spin and wobble.

The wobbling motion of the spray nozzle, which may also be termed "nutational movement," in which the axis of the nozzle itself moves slowly about another axis, is described in more detail in U.S. Pat. No. 6,092,739, owned by Moen Incorporated of North Olmsted, Ohio, the assignee of the present application, the disclosure of which is incorporated by reference. Whereas, the '739 patent discloses and claims wobbling movement of a nozzle, the present application combines the spray pattern resulting from such movement with other types of water spray patterns enabling the shower head user to enjoy several different showering sensations. The shower head also has an auxiliary port which may be utilized to connect a hand-held shower or to direct water to one or more fixed sprays located around the shower enclosure.

Figures 1, 2:
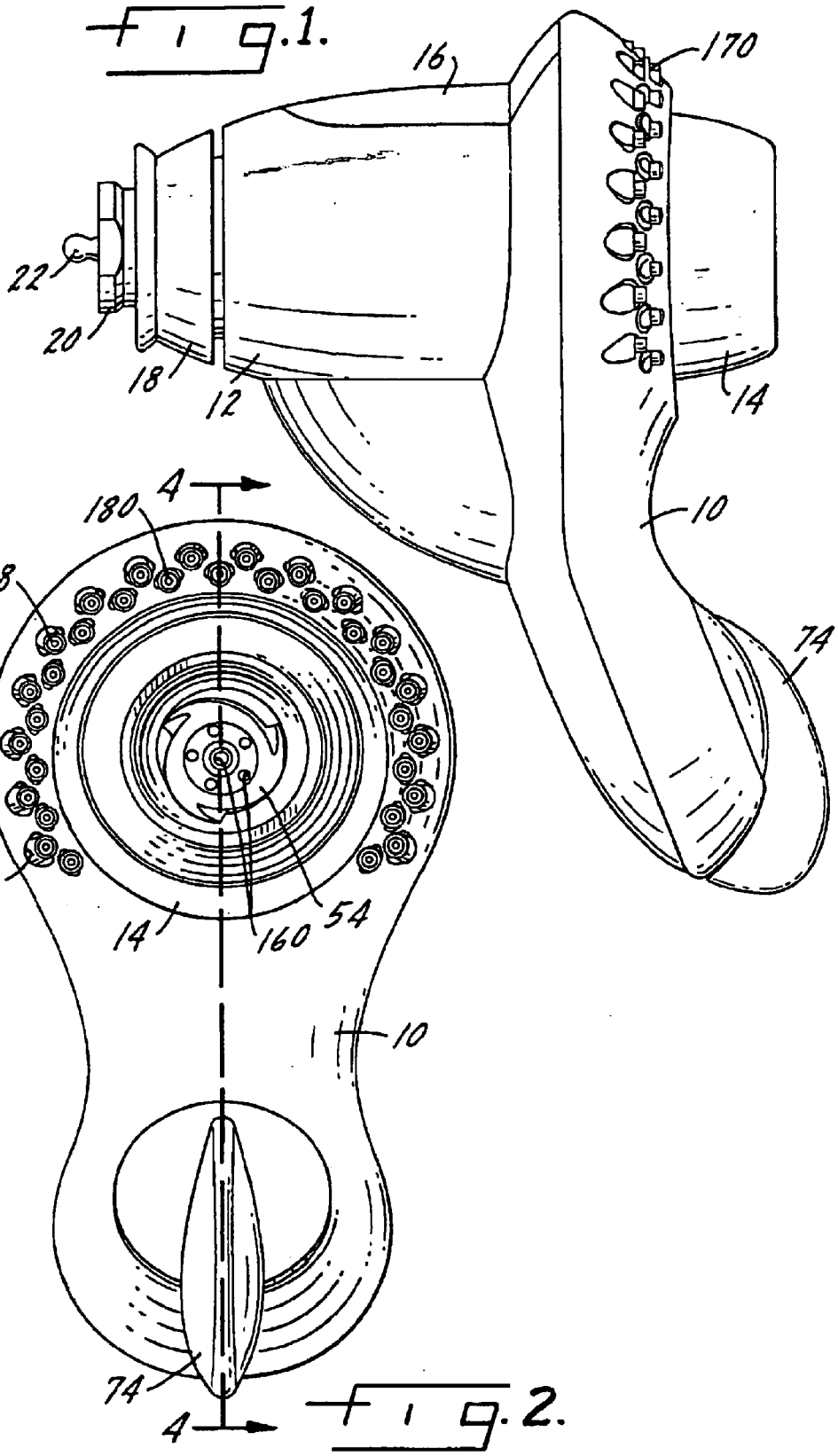
FIG. 1 is a side view of the shower head of the present invention.
FIG. 2 is a front view of the shower head.

FIGS. 1 and 2 illustrate the exterior of the shower head. There is a front cover 10 and a back cover 12. There is an engine cowling extending out from the front cover 10 and indicated at 14. An access cover 16 provides an opening into the back cover 12.

Figure 3:
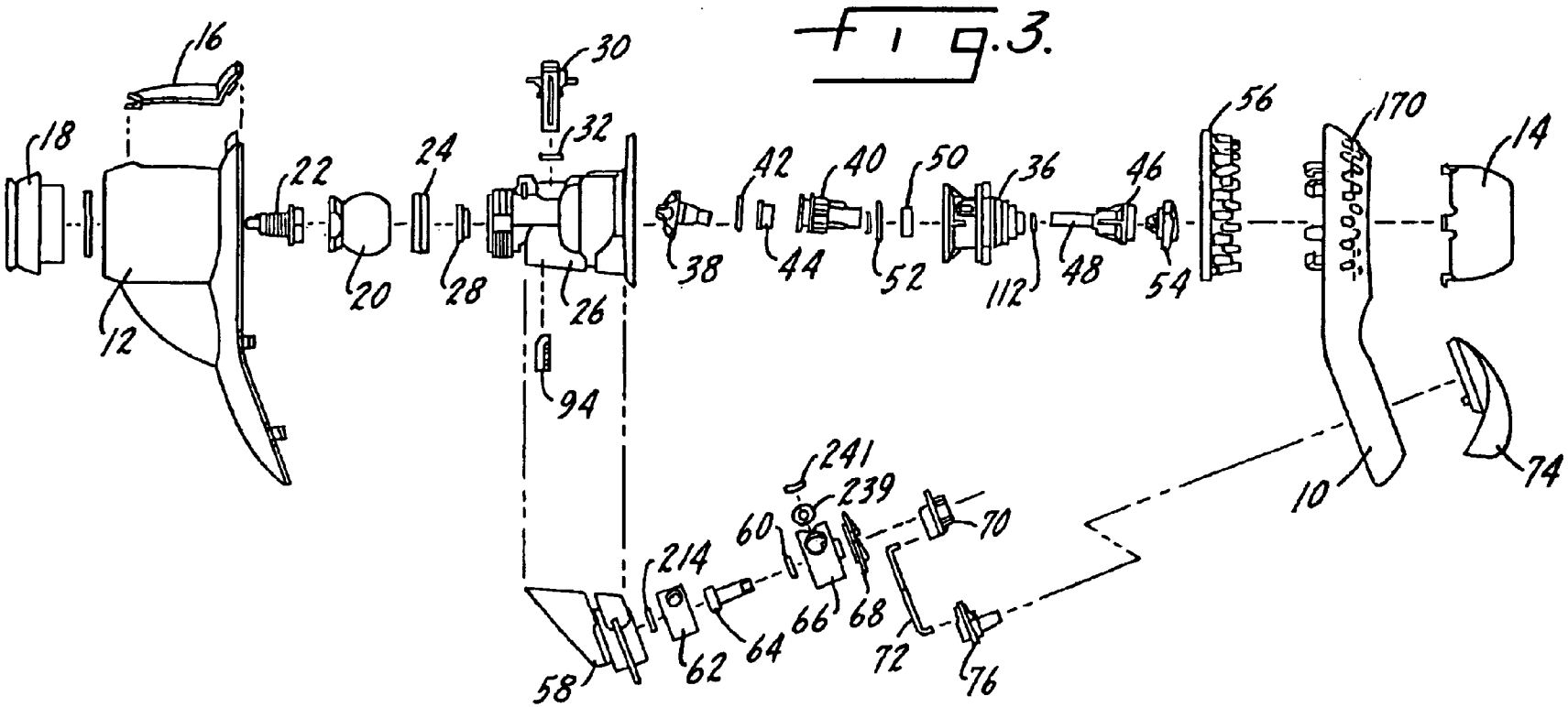
FIG. 3 is an exploded side view showing the components of the shower head.

FIG. 3 is an exploded view of all of the shower head components. Starting at the far left side, a nut 18 is used to attach the back cover to a ball 20 mounting a filter screen 22, with the ball 20 attaching to the conventional water pipe extending out from a shower enclosure wall. There is a seal 24, which is symmetrical in shape, and is shown in position in FIG. 4, which seals the inward end of the ball to the engine housing 26. FIG. 3 is best understood in combination with the section of FIG. 4. A flow regulator 28 is positioned at the inlet of the engine housing, which regulator controls the volume of water flowing into the engine housing and thus to the control valve described hereinafter.

Figure 4:
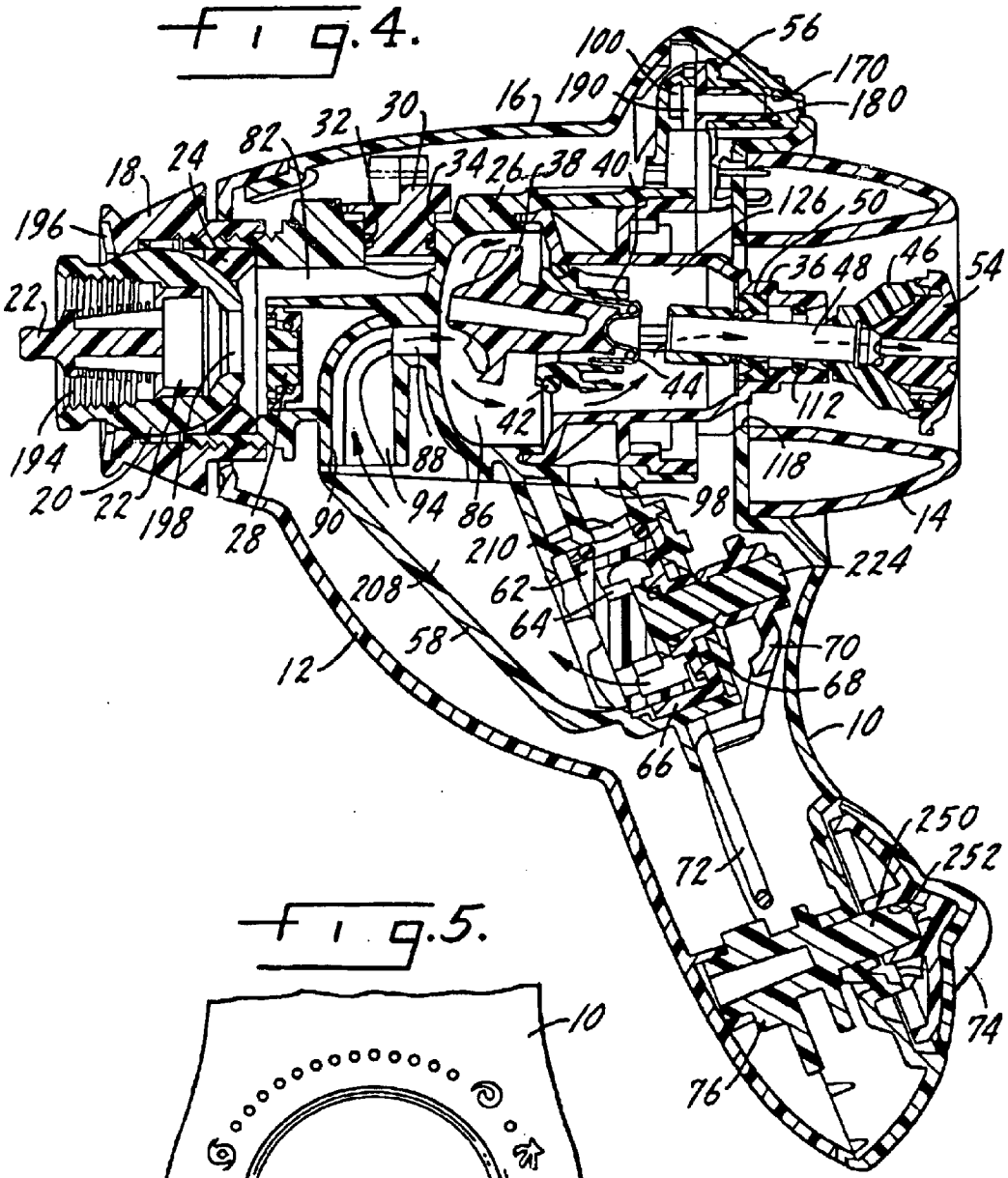
FIG. 4 is a section along plane 4—4 of FIG. 2.
Figure 5:
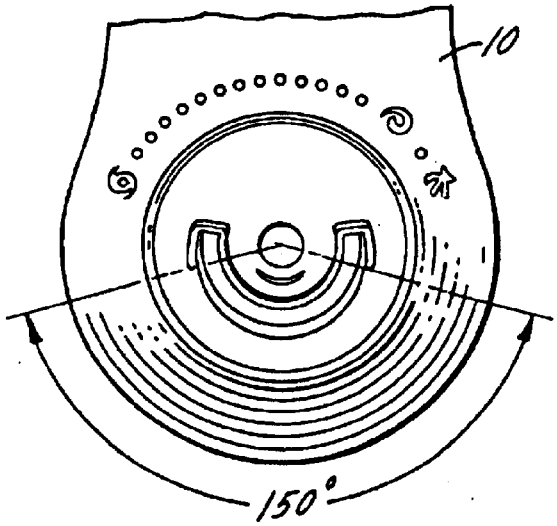
FIG. 5 is a partial front view showing the extent of shower head control knob movement.

There is an auxiliary plug 30 holding a seal 32 which closes an auxiliary port 34 in the engine housing 26, as particularly shown in FIG. 4.

Within the engine housing there is located an end cap 36 which mounts a basket 40. A turbine 38 is positioned within the basket and there is basket O-ring 42 and a pivot ball 44 forming a part of the turbine mounting within the basket 40.

A spray head 46 includes a tube 48 which extends within the end cap 36 and is coaxial with a U-cup 50 and washers 52. A divergence cone 54 is mounted to the end of the spray head.

The spray face plate is indicated at 56 and the engine cowling 14 will be positioned within it. The spray face plate 56 will be covered by the front cover 10 when the shower head is fully assembled.

Focusing on the control valve, there is a valve housing 58, with the valve including a stem seal 60, a rotating sleeve 62, a stem 64 and a seal support sleeve 66. A weld plate 68 covers one end of the valve and there is a stem linkage 70 mounted thereto. The stem linkage 70 is connected by link 72 to knob linkage 76 and through front cover 10 to control knob 74.

The engine housing 26 is detailed in FIGS. 49 through 57 and is shown in position within the covers in FIG. 4. The inward end of the engine housing 26 is threaded, as at 78, for attachment to the nut 18. The flow regulator 28 is mounted within a small chamber 80 directly in the path of water flow from the screen 22. The passage to the auxiliary port 34 is indicated at 82 and this passage bypasses the flow regulator 28. Thus, water may flow directly from the shower head inlet to the auxiliary port which, unless an auxiliary device is connected thereto, is normally closed by the plug 30. The water inlet into the engine housing, downstream of the flow regulator 28, is shown at 84 in FIGS. 55 and 57, with this inlet being connected to the valve housing 58. The engine housing has a wobble chamber 86 into which water flows from a wobble inlet 88, which is connected by a passage 90 to the control valve housing 58. The outer surface of the passage 90 is curved, as at 92, with the inner surface being similarly curved through the use of an insert 94 to thus provide a less turbulent flow path for water which must charge direction approximately 90°. By having this flow path bounded by curved surfaces there is less turbulence, and hence less noise, from the shower head.

There is a spin chamber 96 within the engine housing and water flows into this chamber from the control valve through a spin inlet 98. The outward end of the engine housing has a circumferential trough 100 which will receive water directed to the halo spray openings to be described. As was true of water directed to the wobble chamber and the spin chamber, the flow of water to the trough 100 is regulated by the control valve.

Figure 54:
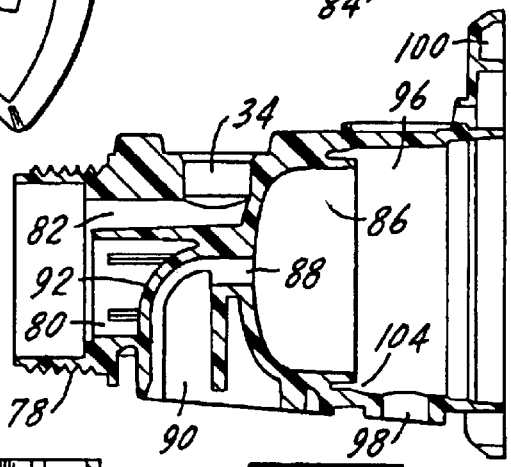
FIG. 54 is a section along plane 54—54 of FIG. 53.
Figure 56:
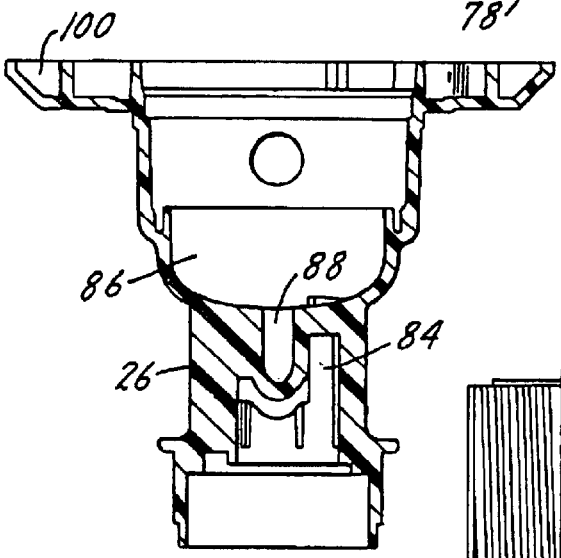
FIG. 56 is a section along plane 56—56 of FIG. 53.
Figure 57:
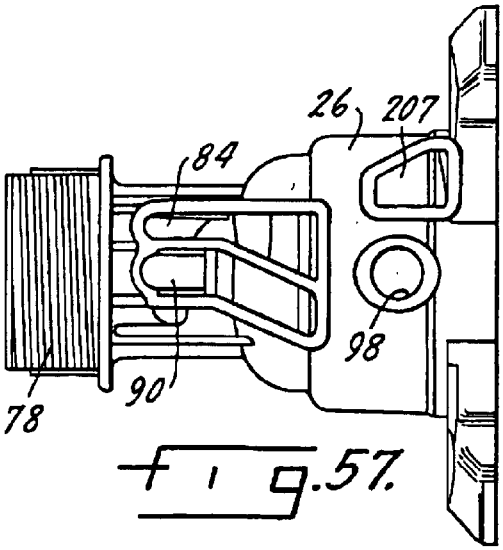
FIG. 57 is a bottom view of the engine housing.
Figure 58:
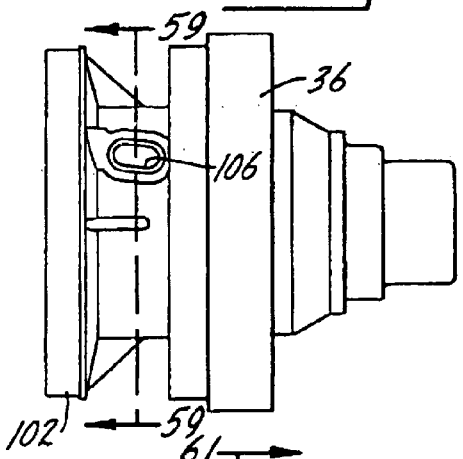
FIG. 58 is a side view of the end cap.
Figure 59:
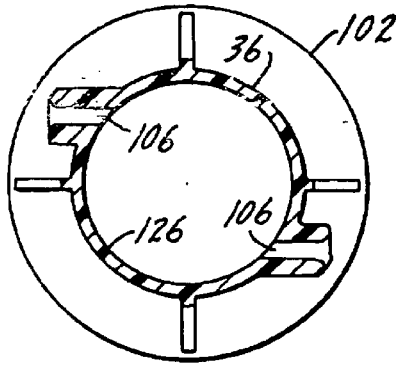
FIG. 59 is a section along plane 59—59 of FIG. 58.
Figure 60:
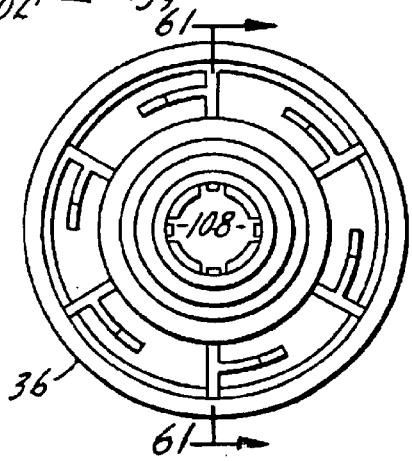
FIG. 60 is a front view of the end cap.
Figure 61:
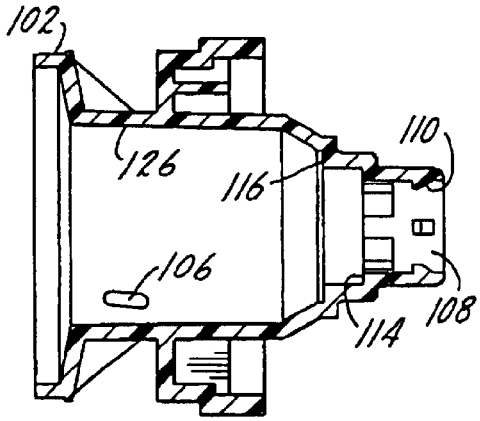
FIG. 61 is a section along plane 61—61 of FIG. 60.

The end cap 36, which is positioned within the engine housing 26, is detailed in FIGS. 58–61. The end cap includes an inwardly extending flange 102 which is received within a peripheral groove 104 at the junction between the engine housing wobble chamber and spin chamber (FIG. 54). Water flowing into the spin chamber from inlet 98 is directed through a pair of opposed and somewhat tangential spin inlet ports 106, illustrated in FIG. 59, from which water will flow into the interior of the end cap. The basket 40 is positioned within the end cap. The outer end of the end cap 36 includes a bore 108 having spaced shoulders 110 which support a bumper 112. Directly adjacent the shoulder 110 is a second shoulder 114 which supports the U-cup 50 which seals against the exterior of the tube 48 forming a part of the spray nozzle. There is a third shoulder 116 which supports the washer 52 illustrated in FIG. 3.

The end cap may be attached to the engine housing so that these two elements are permanently attached together in assembly of the shower head. The end cap extends through an opening 118 in the engine cowling, with the spray nozzle, consisting of the tube 48, the spray head 46 and the divergence cone 54, extending outwardly from the end cap and being surrounded by the engine cowling 14 as particularly shown in FIG. 4.

Figure 65:
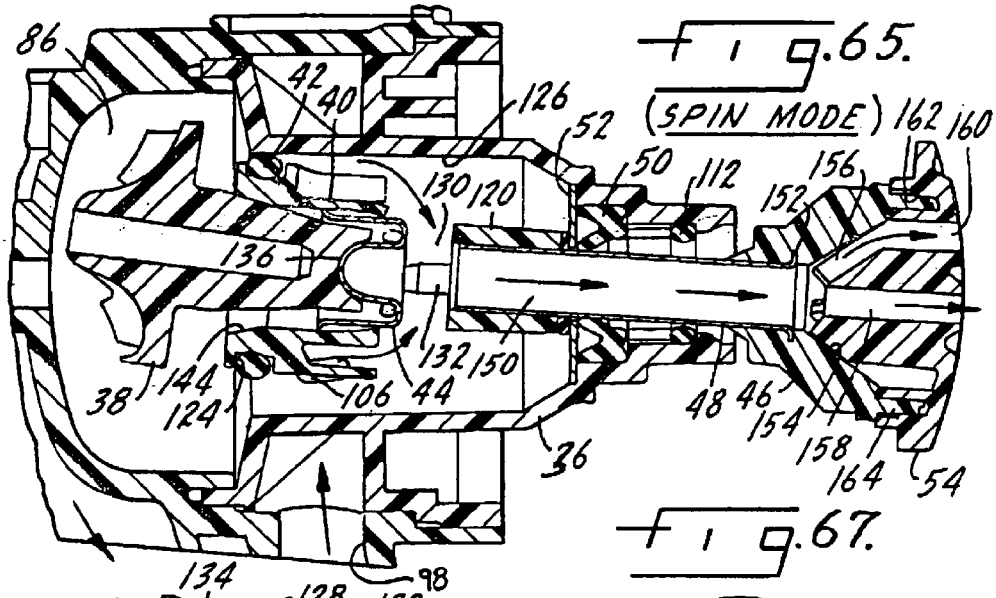
FIG. 65 is an enlarged section showing the turbine, cage and nozzle in a spin mode.
Figure 66:
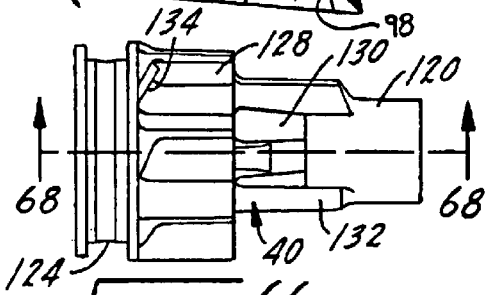
FIG. 66 is a side view of the cage.
Figure 67:
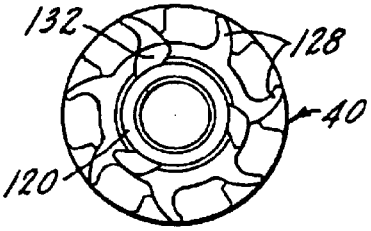
FIG. 67 is a front view of the cage.
Figure 68:
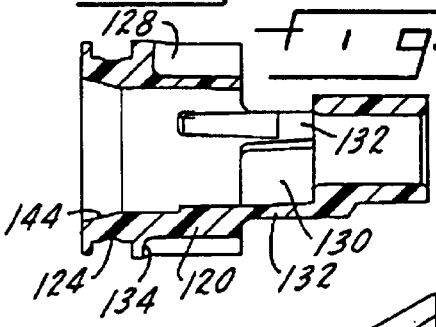
FIG. 68 is a section along plane 68—68 of FIG. 66.

The basket 40 which is positioned within the end cap is shown in FIGS. 66–68 and is shown in position within the end cap and the engine housing in FIGS. 4 and 65. The basket 40 includes a sleeve 120, a bumper 42 in a groove 124 which is at a location in which movement of the basket forces the bumper into contact with wall 126 of the end cap. This wall functions as a track which limits the wobbling movement of the basket and nozzle. The exterior of sleeve 120 has a plurality of non-radial concave curved blades 128, shown particularly in FIG. 67, with the curvature of the blades enabling the water flowing in through the end cap ports 106 to impart a rotary or spinning movement to the basket. By using blades which in effect catch the incoming water, the rotary force imparted to the basket is increased.

Directly downstream from the blades 128 the basket has a plurality of windows 130, each of which is separated by a post 132. As shown particularly in FIG. 67, the posts 132 have a curvature which is effective to direct water flowing towards the cage to move inwardly through the windows to the tube 48 of the nozzle. The upper end of the space between the adjacent blades 132 has a downwardly facing curve 134 which provides a slight lift to the basket as it rotates within the end cap to reduce friction. The blades 128 are the driving blades which cause the basket to turn and the curved posts 132 function as pumping blades directing water inwardly toward the tube which carries the water to the nozzle.

Figure 62:
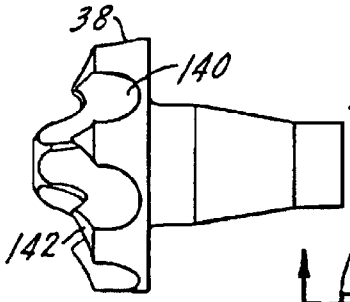
FIG. 62 is a side view of the turbine.

The interior of the sleeve 120 encloses the pivot ball 44, with the pivot ball, at its center, having an inwardly-directed convex curved projection 136 which supports the turbine 38. The turbine 38 is shown in detail in FIGS. 62–64 and has a socket 138 at its outward end which is seated upon the convex projection 136. The turbine wobbles about the pivot ball. It is advantageous to have a downwardly facing socket at the outer end of the turbine so that water may be flushed from this connection to reduce the possibility of sediment in the water being caught in this joint and causing wear to the turbine.

Figure 63:
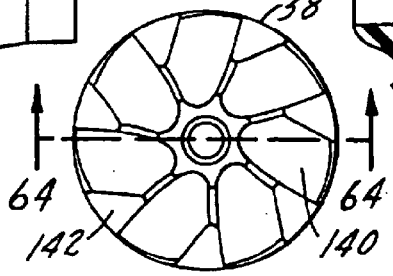
FIG. 63 is a rear view of the turbine.
Figure 64:
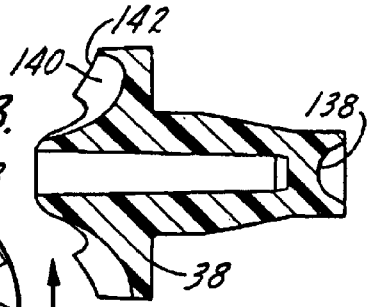
FIG. 64 is a section along plane 64—64 of FIG. 63.

The turbine 38 has a plurality of concave grooves 140 which face the wobble inlet 88, with these grooves being non-radial in configuration, as particularly shown in FIG. 63. The grooves form concave blades 142 which function in the same manner as the concave blades on the cage. Water is directed axially toward the turbine, but the concave non-radial shape of the blades 142 causes the water to turn at approximate 90° towards the wall of the wobble chamber. The effect of this turning motion of the water is to move the turbine toward the inside surface 144 of the basket 40, which surface limits the degree of wobble movement of the turbine. In effect, the incoming water is caught by the turbine blades and thrown outwardly, and as a result, the turbine moves at an angle 90° to water direction. Also, since the grooves that form the blades are non-radial, the water will impart a turning moment to the turbine which causes it to rotate. There are three movement components caused by the water striking the turbine: a rotary movement, a wobbling movement, and a downward movement which assists in creating the wobbling movement. Although the downward movement is to be minimized, it is necessary to keep the turbine on the convex projection 136.

Wobbling movement is described in more detail in the above-referenced '739 patent, but it may be considered to be a nutational movement in which the axis of the turbine moves slowly about another axis other than the axis of the turbine itself. This wobbling movement of the turbine is imparted to the basket, which in turn imparts this movement to the nozzle to which the basket is fixed. The space between the inner end of the turbine and the opposing surface of the wobble chamber having the wobble inlet 88 is less than the depth of the concave recess in the turbine so there is no possibility of the turbine being inadvertently moved to a non-functional position.

Figure 70:
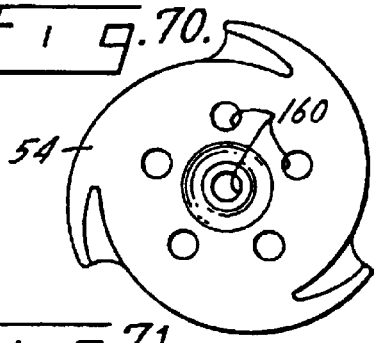
FIG. 70 is a front view of the diverging cone.
Figure 69:
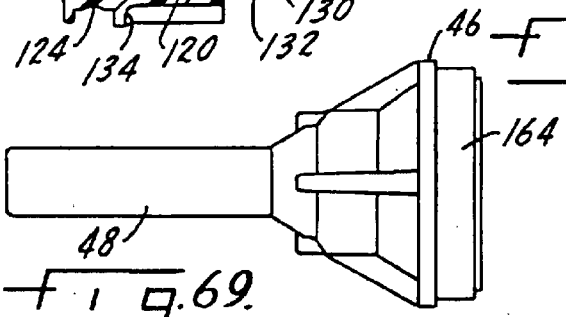
FIG. 69 is a side view of the spray head.
Figure 71:
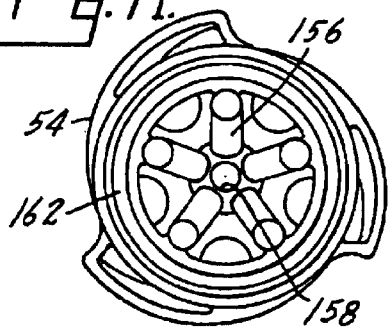
FIG. 71 is a rear view of the diverging cone.

The nozzle assembly is illustrated in FIGS. 69–71 and includes the spray head 46 having a tube 48 with an interior 150, which tube extends into and is fixed to the basket 40, as particularly shown in FIGS. 4 and 65. The tube 48, which is outwardly flared as at 152, extends into the spray head which has a conical chamber 154 at its outward end within which is positioned the divergence cone 54. The cone 54, as particularly shown in FIG. 71, has a plurality of slots, in this case five, indicated at 156, and a center passage 158, the combination of these passages forming the water conduits to the spray nozzle openings 160. The cross sectional area of the passages 156 and 158 are each equal and the total cross sectional area of these combined slots and openings is greater than the cross sectional area of the tube 48 so there is no back pressure on the water flowing outwardly through the nozzle. The divergence cone has an annular groove 162 which receives an annular projection 164 of the spray head to connect those elements into a unitary spray nozzle.

As illustrated particularly in FIG. 4, which shows the shower head in a wobble mode, wobble movement of the basket and nozzle is limited at two locations. First, by the contact of bumper 42 against the wall 126 at the inner end of the combined nozzle and basket, and second, by the contact of the exterior of tube 48 and bumper 112 at or near the outer end of the nozzle. The diameter ratio between bumper 42 and the wall 126 upon which it turns is the same ratio as that between the exterior of tube 48 and the interior of bumper 112. Essentially, the combined basket and nozzle wobble about a pivot between these points of limiting movement. This dampens noise from the wobbling motion and maximizes the life of the bumpers because there is no side-to-side movement of the tube or the basket at the points of contact.

The spray openings in the nozzle are somewhat close together, but the net effect of these openings, and particularly when the shower head is in a wobble mode, is to create a substantially solid body of water that strikes the user with a strong impact. In the spin mode, even though these openings are close together, the net effect is somewhat softer because the spin movement of the connected basket and nozzle causes the water flowing out of the nozzle openings to be broken up into small droplets providing a substantially softer feel to the user.

Figure 47:
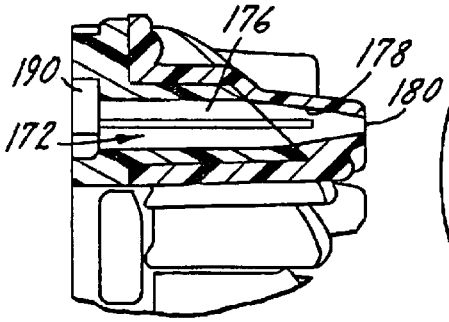
FIG. 47 is an enlarged partial section of one of the spray face plate inner row openings.
Figure 51:
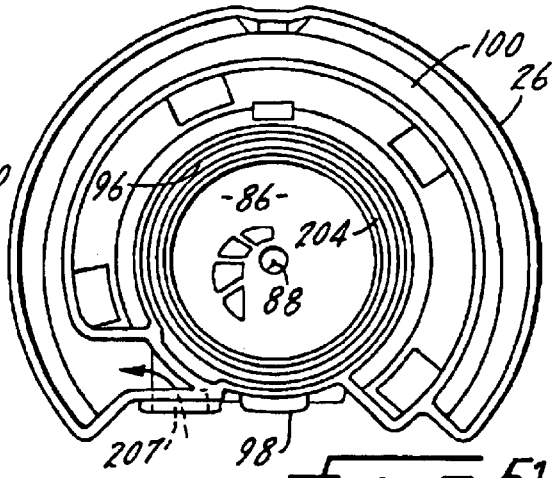
FIG. 51 is a front view of the engine housing.
Figure 52:
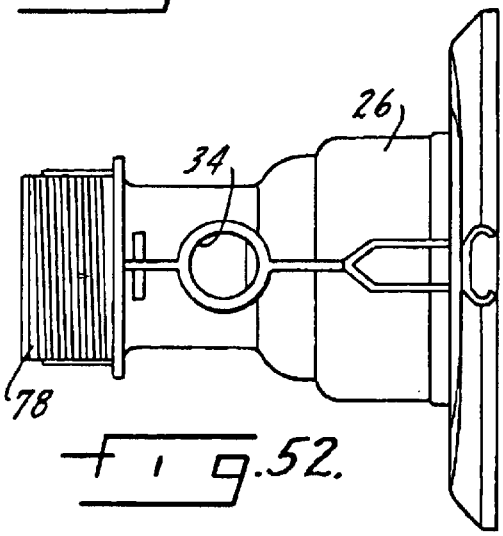
FIG. 52 is a top view of the engine housing.
Figure 48:
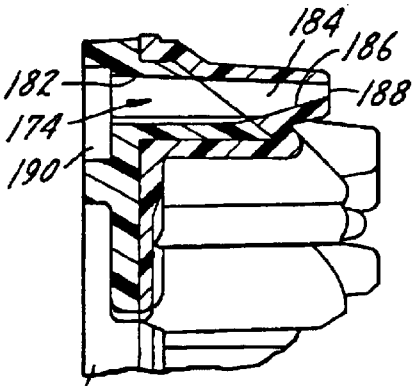
FIG. 48 is an enlarged partial section of one of the outer row spray face plate openings.
Figure 53:
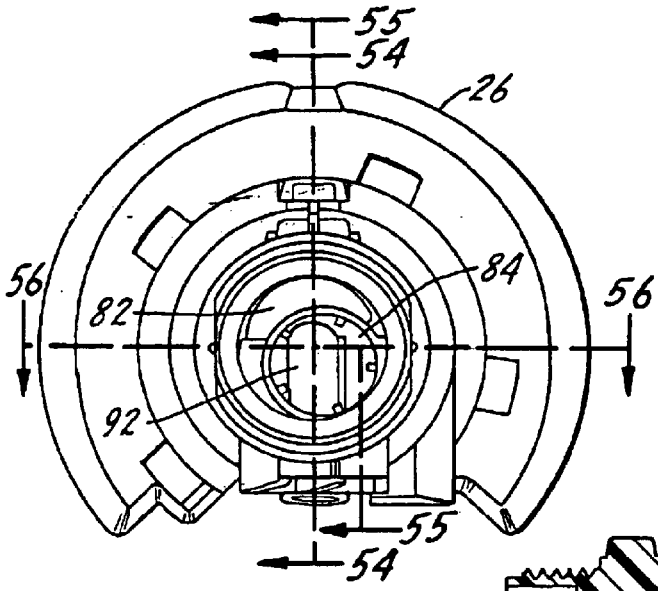
FIG. 53 is a rear view of the engine housing.
Figure 55:
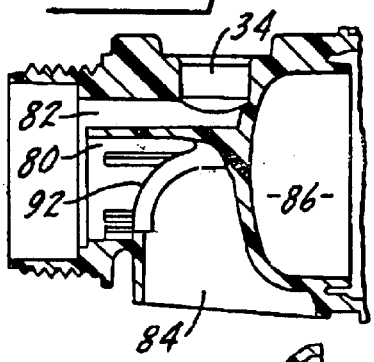
FIG. 55 is a section along plane 55—55 of FIG. 53.

Details of the halo spray openings are shown in FIGS. 45–48 which illustrate the spray face plate 56. Water passing from this plate flows through the openings 170, shown in FIG. 1, of the front cover. The spray plate face 56 is partially circumferential, as particularly shown in FIG. 46, and includes an inner row of spray openings 172 and an outer row of spray openings 174. FIG. 45 is a side view of the spray face plate. FIGS. 47 and 48 illustrate details of the inner and outer row spray face plate openings. FIG. 47 shows the inner row and each opening includes a generally cylindrical passage 176 which terminates in a symmetrical cone 178, at the end of which is the opening 180. Because the walls of the tapered portion 178 are symmetrical, water flowing into and through the described passages will exit the opening 180 in a direction along the axis of the passage. Thus, the inner row of openings 172 will provide a spray pattern in which the individual water paths from each opening are generally in a direction axial with the face plate of the shower head.

FIG. 48 shows the outer row of openings 174. In this instance there is again a cylindrical passage 182, but the cone at the end of the passage 182, indicated at 184, is asymmetrical and its inner wall 186 will cause the water flowing through the opening 188 at the end of the passage to be directed outwardly of, or away from, the axis of passage 182. Thus, water flowing from the outer row of spray openings diverges outwardly from the face plate of the shower head. The end result of water flow from the described two rows of halo openings is a spray pattern which is wider then the face plate through which the water passes. The spray pattern diverges and is of a greater width than the width of the shower head at the point where the water passes through it.

The face plate 56 has an interior trough 190 which faces the trough 100 in the engine housing. When these two elements are connected together, the combined troughs provide a channel for water to flow circumferentially about the spray head and to the described spray openings.

Turning to FIG. 4, the ball 20 has an interior thread 194 which will be used to attach the shower head to a water pipe extending outwardly from a shower enclosure wall. The filter screen 22 is coaxially positioned within the ball 20 and removes sediment from water flowing into the shower head. This removal is particularly important in a shower head of the design shown herein because of the multiple moving parts and the possibility of damage if sediment within the water should become lodged between a pair of moving elements.

The nut 18 may have a reinforcing ferrule 196 to reinforce the bearing surface between the ball 20 and the nut 18. As described earlier, the nut 18 threadedly engages and mounts the engine housing 26. Water flowing through the ball 20 passes through its opening 198 and from there into the described passages to the flow regulator 28 and to the auxiliary port.

Figure 29:
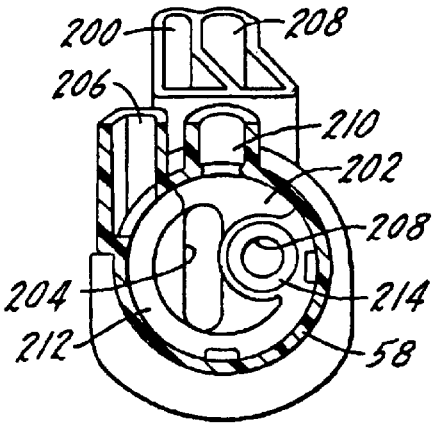
FIG. 29 is a section along plane 29—29 of FIG. 28.
Figure 30:
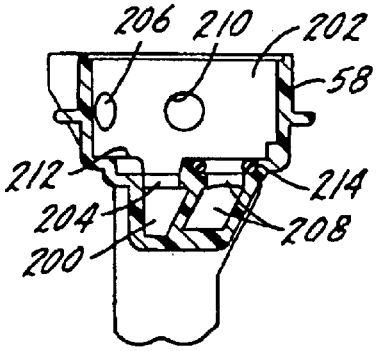
FIG. 30 is a section along plane 30—30 of FIG. 25.

The control valve housing is indicated at 58 and the illustration of water flow into and out of this housing is shown in FIGS. 21–24. The housing itself is detailed in FIGS. 25–30. The inlet into the control valve housing 58 is shown at 200 and water passes from this inlet into the valve chamber 202 through an opening 204. The halo outlet from valve housing 58 is indicated at 206, the wobble outlet is indicated at 208, and the spin outlet is indicated at 210. As particularly shown in FIG. 29, the inlet opening 204 is elongated with curved ends, but has a raised boss 212 upon which a portion of the valve moves as described hereinafter. A seal ring 214 may seal the wobble outlet, as particularly shown in FIG. 29.

Figure 31:
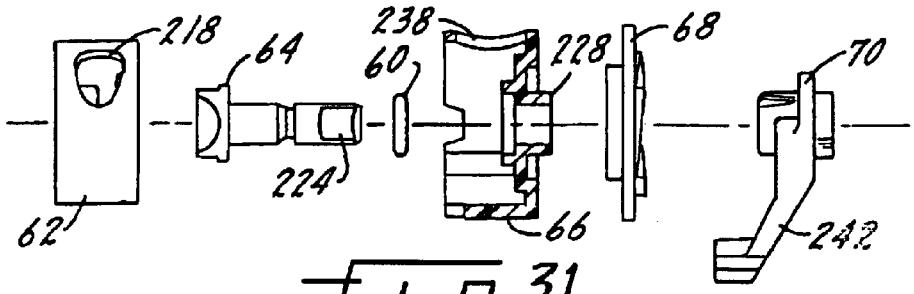
FIG. 31 is an exploded view of the control valve.
Figure 32:
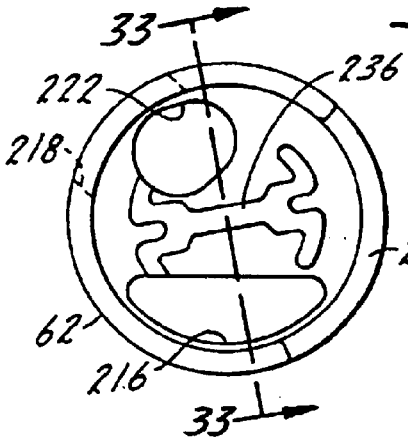
FIG. 32 is a front view of the control valve rotating sleeve.
Figure 33:
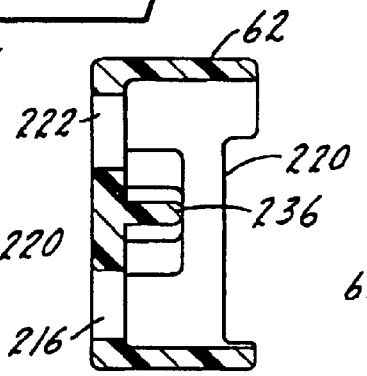
FIG. 33 is a section along plane 33—33 of FIG. 32.
Figure 34:
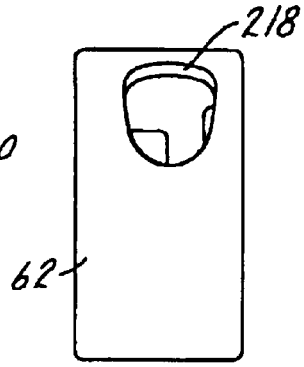
FIG. 34 is a side view of the rotating sleeve.
Figure 35:
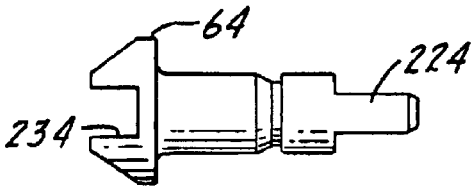
FIG. 35 is a side view of the control valve stem.
Figure 36:
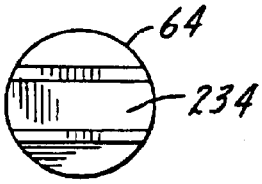
FIG. 36 is a rear view of the control valve stem.
Figure 37:
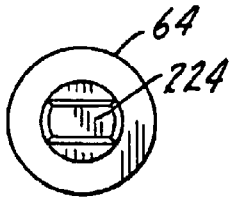
FIG. 37 is a front view of the control valve stem.

The elements of the control valve are shown in the exploded view of FIG. 31. The rotating sleeve 62 has a bottom inlet 216, a side outlet 218, and a recessed area 220 which functions to permit water to flow outwardly from the rotating sleeve. Similarly, the sleeve has a bottom outlet 222, shown in FIG. 32.

The rotating sleeve 62 is positioned within and rotates relative to the seal support sleeve 66. The stem 64 has a stem extension 224 which mounts a quad seal 60, with the extension extending through a boss 228 on the seal support sleeve 66. The stem 64 will pass through a central opening 230 in the weld plate 68 where it engages the stem linkage 70.

Figure 38:
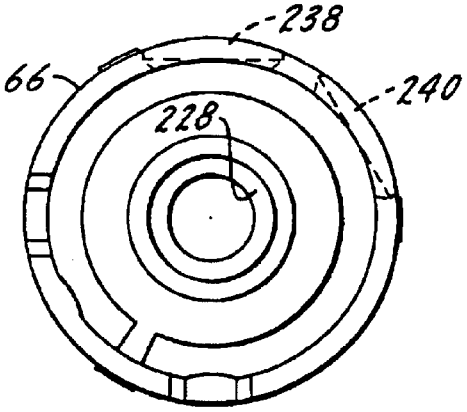
FIG. 38 is a rear view of the seal support sleeve.
Figure 39:
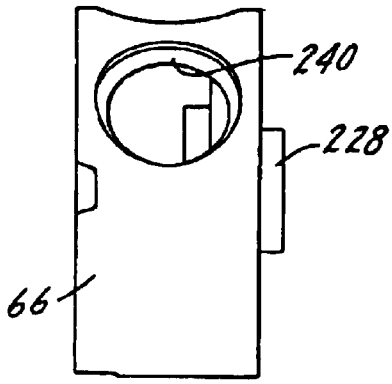
FIG. 39 is a side view of the seal support sleeve.
Figure 49:
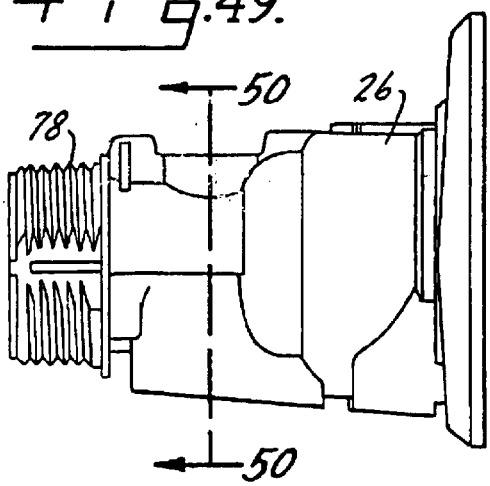
FIG. 49 is a side view of the engine housing.
Figure 50:
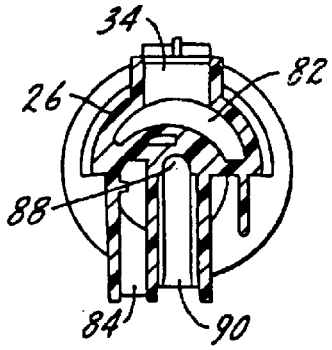
FIG. 50 is a section along plane 50—50 of FIG. 49.

The stem 64 has a groove 234 within which extends a projection 236 on the rotating sleeve 62 to interlock these two elements for concurrent rotation. The seal support sleeve 66, which is detailed in FIGS. 38 and 39, serves as the enclosing body for the rotating sleeve 62 and itself is located within the chamber 202 of the valve housing 58. The sleeve 66 has a pair of side outlets 238 and 240, with outlet 238 functioning as the halo outlet and outlet 240 as the spin outlet. The wobble outlet is opening 222 in the rotating sleeve 62. Each of the outlets 238 and 240 will have suitable seal rings 239 and 241 (FIG. 3), respectively, positioned therein, with the seal rings bearing against the interior of the valve housing chamber 202.

As indicated above, the stem linkage 70 is attached to and will cause rotation of the stem 64 and the rotating sleeve 62. The stem linkage is detailed in FIGS. 42–44 and has an arm 242 with an opening 244 at the end thereof. This arm will receive one end of the link 72 shown in FIG. 15A. The link 72 may be a rigid wire and will transfer motion from the control knob 74 to the stem linkage 70, the stem 64, and the rotating sleeve 62 to effect a change in the spray pattern from the shower head.

The linkage knob 76 is shown in FIGS. 16, 17, and 18 and includes a stem portion 250 which extends into a control knob opening 252 so that turning movement of the control knob 74 will move the linkage knob 76. The linkage knob 76 has an opening 254 which will receive one end of the link 72. The result of the interconnection between the control knob 74 and the control valve is that rotation of the control knob will turn the rotating sleeve 62 of the control valve. However, there is a degree of lost motion in this connection, as 150° of rotation of the control knob will provide 95° of rotation of the rotating sleeve. What is important is that the shower user have the ability, from a readily accessible location, to operate the control knob, to change the spray pattern.

Following is a description of the operation of the shower head and its several modes of differing spray patterns. FIG. 6 illustrates the maximum extent of control knob movement. As shown in this figure, the control knob 74 is in a halo position as it points to the symbol on the front cover that represents regular streams of water. Counterclockwise movement will cause the rotating sleeve of the valve member to change the valve housing discharge from the full halo position of FIG. 6 to the mixed halo/spin position of FIG. 9. Further counterclockwise movement will result in the spin position of FIG. 11, and continuing counterclockwise movement will place the control knob in the spin/wobble position of FIG. 13. Yet further counterclockwise movement will cause the control knob to reach the full wobble position of FIG. 15.

Figure 8:
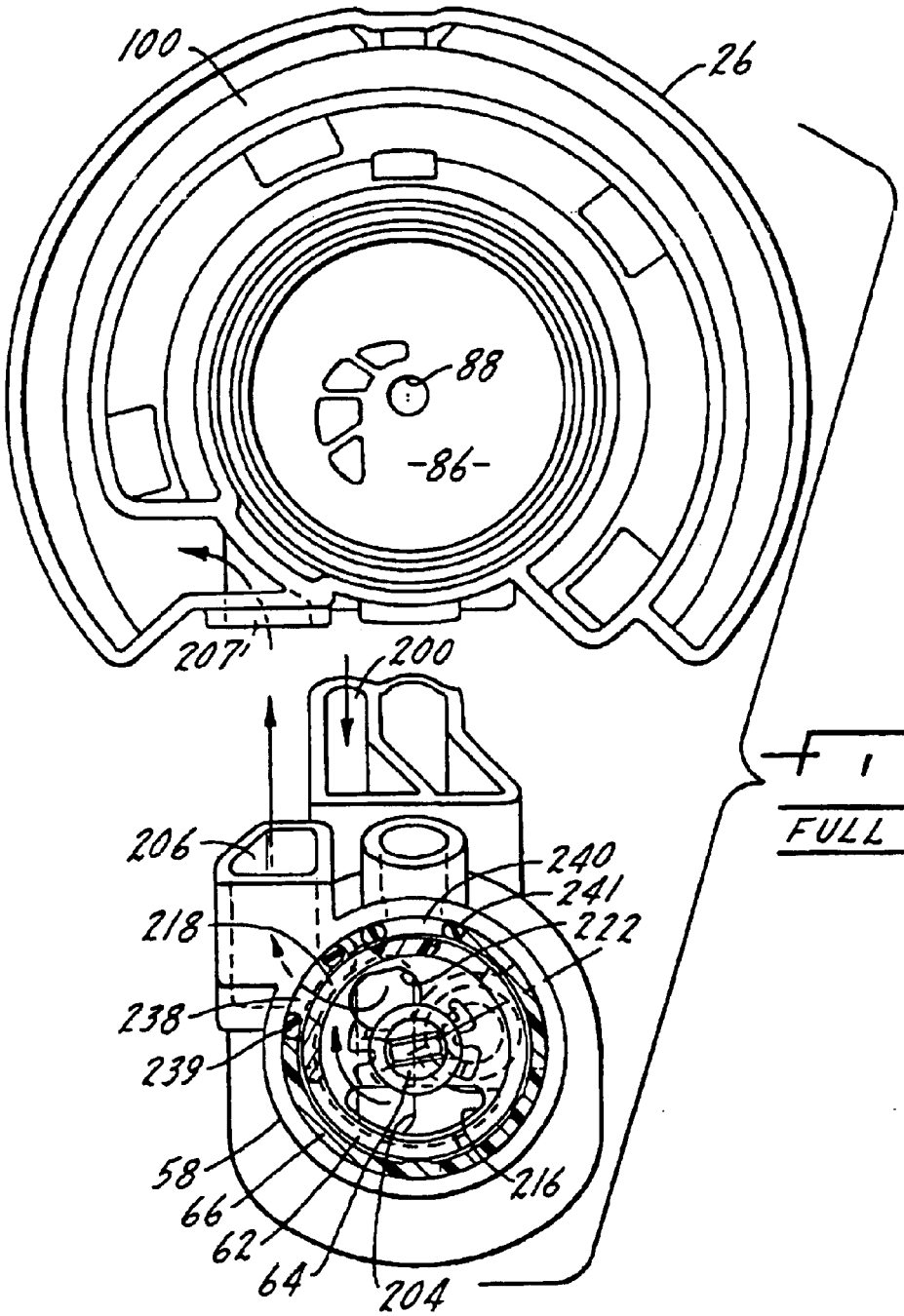
FIG. 8 is an enlarged partial front view with the cover removed showing the control valve in full halo position.

FIGS. 7 and 8 illustrate the valve and the control knob linkage in a full halo position. Water flows into the valve housing 58 through the passage 200, illustrated by the arrow in FIG. 7. Water flows out from the halo outlet 206 into inlet 207 of the engine housing illustrated in FIGS. 8, 51 and 57. To reach the engine housing and face plate troughs which pass water to the halo outlets, and focusing on FIG. 4, water flows into a circumferential recess 100 on the outside of the engine housing and from this recess it reaches the described troughs which feed the halo openings in the spray face plate 56.

Figure 21:
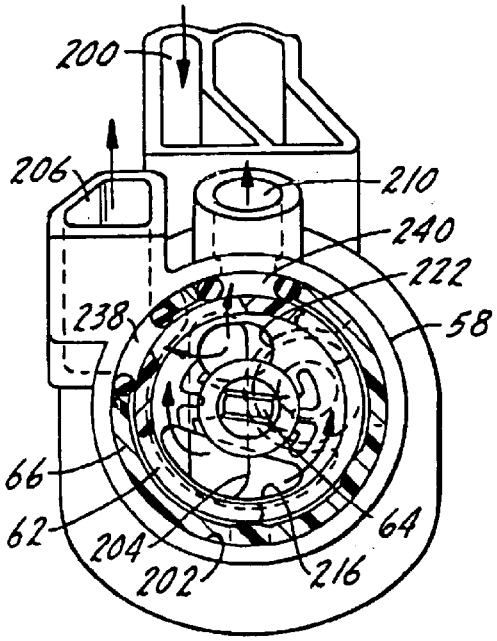
FIG. 21 is a diagrammatic illustration of the control valve and its inlet and outlet port water flow in a halo/spin position.

FIGS. 9, 10 and 21 illustrate the positions of the control knob and valve in a halo/spin mixed discharge position. FIG. 9 shows the position of the control knob and FIG. 10 shows the inlet and outlet water flow paths to both the spin and halo openings. FIG. 21 illustrates water flow through the valve itself. Water enters the center of the rotating sleeve 62 through the opening 204 and the inlet 216 and exits through sleeve outlet 218 and the side openings 238 and 240 of the seal support sleeve. Water will exit the valve housing 58 through outlets 206 and 210 and flow in the described halo path and will flow into the spin chamber, as illustrated by the water flow arrows in FIG. 65.

Figure 22:
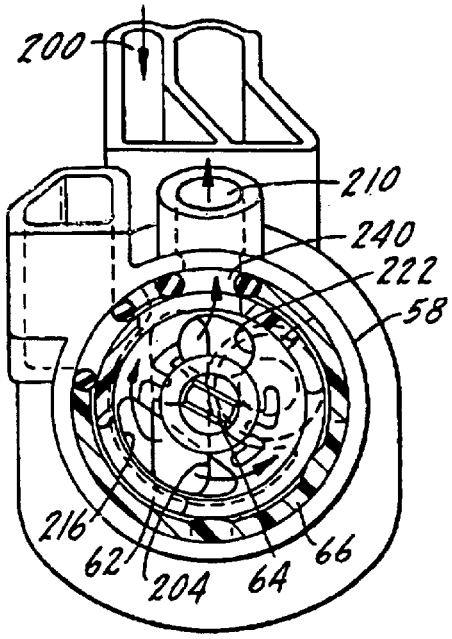
FIG. 22 is a view similar to FIG. 21, showing the control valve and its inlet and outlet port water flow in a spin position.

FIGS. 11, 12 and 22 illustrate the path of water flow in a pure spin position. Note the position of the control knob in FIG. 11 where it has moved further counterclockwise than shown in FIG. 9. FIG. 22 shows water flowing into the valve housing and water flowing out of the side outlet 240 in the seal support sleeve. FIG. 22 shows the path of water flow through the valve, from the valve housing inlet 200, to the valve housing opening 204, to the inlet 216 of the rotating sleeve 62, out the rotating sleeve outlet 218 and to the side outlet 240 of the seal support sleeve 66 and then to the valve housing outlet 210.

Figure 23:
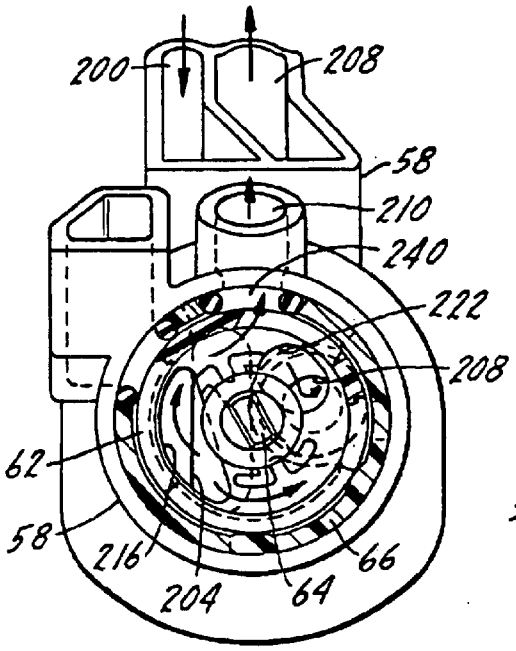
FIG. 23 is a view similar to FIGS. 21 and 22, showing the control valve and its inlet and outlet port water flow in a spin/wobble position.

FIGS. 13, 14 and 23 similarly show the path of water flow in a mixed spin/wobble position. Note the position of the control knob 74 in FIG. 13 and the position of the valve in FIG. 14 with the arrows indicating the incoming flow of water into the valve housing and the outflow of water through the spin and wobble outlet water passages 210 and 208, respectively, of the valve housing. In FIG. 23, there is a similar illustration of water flow through the valve itself, including an indication that water flows out of the rotating sleeve 62 through both its side outlet 218 (to spin outlet 210) and its bottom outlet 222 (to the wobble outlet 208).

Figure 24:
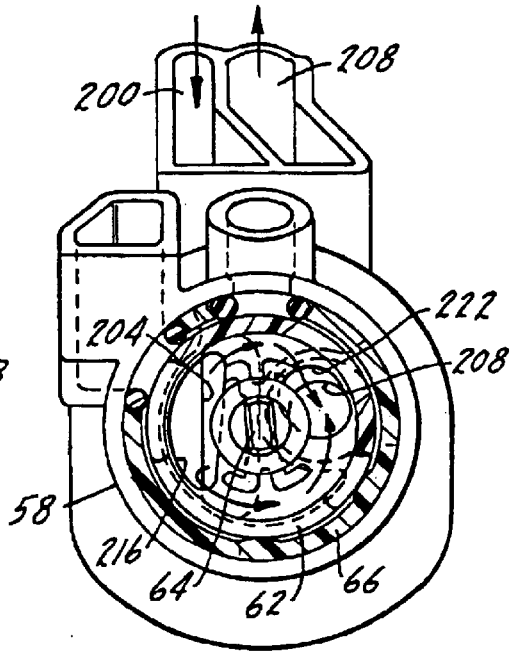
FIG. 24 is a view similar to FIGS. 21–23, showing the control knob and its inlet and outlet port water flow in a wobble position.
Figure 25:
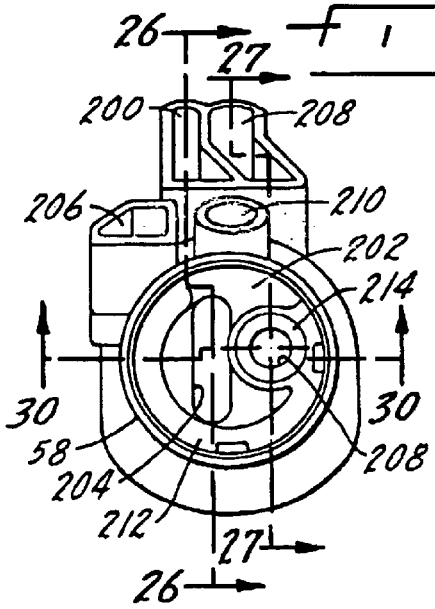
FIG. 25 is a front view of the control valve housing.
Figure 26:
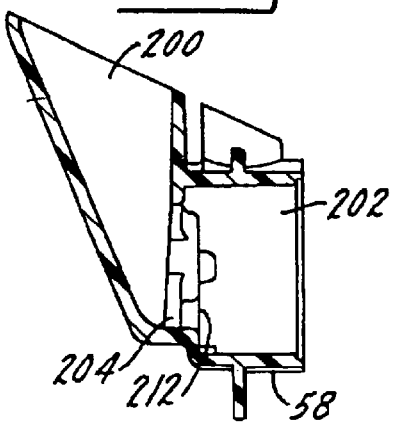
FIG. 26 is a section along plane 26—26 of FIG. 25.
Figure 28:
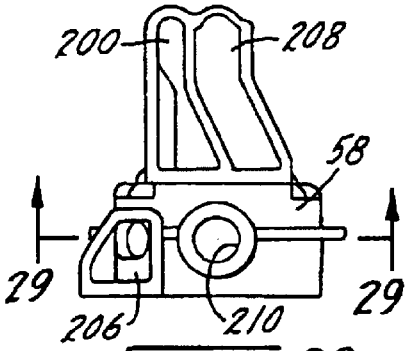
FIG. 28 is a top view of the control valve housing.
Figure 27:
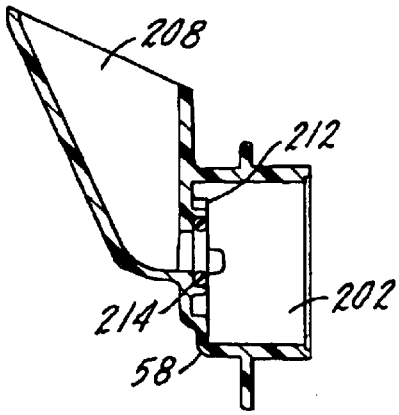
FIG. 27 is a section along plane 27—27 of FIG. 25.

In like manner, FIGS. 15, 15A and 24 illustrate the path of water flow in the position of the control knob and valve when all water is directed to the wobble chamber. Again, water flow follows the directional arrows shown which are self explanatory.

Focusing now on movement of the turbine and basket and nozzle during the described positions of the control knob and control valve, attention should be directed to FIGS. 4 and 65. FIG. 4 illustrates the water flow pattern in a maximum wobble position. Water flows through the wobble outlet 208 into engine housing inlet 90 and through the wobble inlet 88 into the wobble chamber 86 and impinges upon the turbine 38. The turbine will wobble or have a nutating movement, as described above. Movement of the turbine is limited by contact between that element and the interior wall of the basket. The wobbling movement is imparted to the basket which is fixed to the nozzle with the result that the nozzle will have a wobbling type of motion. As such it will have a focused and somewhat hard massaging or kneading spray pattern with the water following the direction of the arrows in FIG. 4. Water is thrown outwardly by the wobbling motion of the turbine and will flow outside of a portion of the basket, through the window openings in the basket, and then down through the center of the tube to the nozzle openings in the divergence cone. This type of motion of the nozzle is described in the '739 patent referenced above.

Spin motion is illustrated in FIG. 65. In this instance, water does not contact the turbine and cause it to wobble, but rather flows directly against the basket 40. Note the arrows in FIG. 65. Water flows from the spin outlet 210 of the valve housing 58 to the spin inlet 98 of the engine housing 26 and from there into the spin chamber 96 and through the spin inlet ports 106 of the end cap 36. Water impinging against the blades of the basket cause it to spin or rotate as described above. This spinning motion is essentially coaxial with the axis of the basket and the nozzle and there is no wobble motion. Because the nozzle is spinning faster, the water droplets flowing out of the openings 160 will tend to be broken up and there will be a softer, less focused spray pattern from the nozzle.

As described above, there may be a combination of wobble and spin motions, depending upon the position of the control knob. When moving the knob in a counterclockwise direction, the shower user may first be in a full spin mode with further movement in a counterclockwise direction providing a mixed wobble/spin spray discharge. In this instance, water flows into both the wobble chamber and the spin chamber and the nozzle will both wobble and spin, but the extent of wobbling movement is less than when the control knob is in a full wobble position.

The direction of rotation of the basket and nozzle when in the spin mode is the same direction of rotation which is imparted to these elements when the shower head is in a full wobble mode. It could be otherwise, but greater control is provided to the shower user by having concurrent directions of rotation of these two elements when they are operating simultaneously.

The shower head described and disclosed herein provides for three different spray patterns, plus combinations of these patterns. In a pure halo mode, the spray pattern is much like that of a conventional shower head. In a pure spin mode, there is a soft somewhat focused spray having a rainlike feeling. The wobble movement of the nozzle provides deceasing coverage of the spray pattern, but increasing force or a more focused spray which gives a kneading massage feeling to the shower user.

The provision of an auxiliary port allows the shower head to be used with other showering devices, such as a hand-held shower or fixed shower sprays, which may be set in varying directions within a shower enclosure.

The shower head user is offered a full range of shower sensations by variation of a readily accessible control knob. There is a continuous range of adjustment of force, frequency and coverage for the shower user.

Whereas the preferred form of the invention has been shown and described herein, it should be realized that there may be many modifications, substitutions and alterations thereto.

The embodiments of the invention in which an exclusive property or privilege is claimed are defined as follows:

1. A shower head including a housing, a water inlet in said housing, a control valve in said housing having a water inlet and a plurality of water outlets, a water passage between said housing inlet and said control valve inlet, a plurality of peripherally arranged spray openings in said housing, a spray opening water passage between one of said control valve outlets and said spray openings, a spray nozzle on said housing having a plurality of outlets and a water conduit connected thereto, a wobble inducing member in said housing and associated with said nozzle to impart a wobbling motion thereto, a wobble water passage between another one of said valve outlets and said wobble inducing member whereby water passing from said control valve to said wobble inducing member causes it to wobble and to induce wobble in said nozzle, said wobble water passage communicating with said nozzle conduit to supply water to said nozzle outlets, a spin inducing member in said housing and associated with said nozzle to impart a spin motion thereto, a spin water passage between yet another one of said valve outlets and said spin inducing member, whereby water passing from said control valve to said spin inducing member causes it to spin and to induce spin in said nozzle, said spin water passage communicating with said nozzle conduit to supply water to said nozzle outlets, said control valve being movable between positions to direct water from said control valve inlet to said control valve outlets.

2. The shower head of claim 1 wherein said control valve is movable between positions to direct water from said control valve inlet to each control valve outlet, and to direct water simultaneously to more than one control valve outlet.

3. The shower head of claim 2 wherein said control valve is formed and adapted to simultaneously direct water to said spray opening water passage and to said spin water passage, and to said spin water passage and said wobble water passage.

4. The shower head of claim 1 wherein said control valve includes a seal support sleeve having outlet ports therein and a rotating sleeve positioned within said seal support sleeve and having an inlet port therein.

5. The shower head of claim 4 wherein said rotating sleeve further includes an outlet port therein.

6. The shower head of claim 4 further including a stem attached to said rotating sleeve, a control member, located on said housing remote from said control valve, and a linkage connected between said control member and said stem.

7. The shower head of claim 1 wherein said wobble inducing member includes a turbine having a plurality of blades, said turbine and said turbine blades being in alignment with and facing said wobble water passage.

8. The shower head of claim 7 wherein said housing includes a turbine chamber, with said turbine being positioned within said chamber, said wobble water passage opening into said turbine chamber.

9. The shower head of claim 8 wherein said turbine blades are non-radial.

10. The shower head of claim 9 wherein said turbine blades have a concave shape with the result that water directed onto said blades from said wobble water passage is turned by said blades approximately 90°, with the result that the turbine is moved by water from said wobble water passage in a direction approximately 90° to the wobble water passage.

11. The shower head of claim 10 wherein water directed at said non-radial blades cause said turbine to rotate.

12. The shower head of claim 7 wherein said nozzle includes a post, said turbine being movably positioned on said post.

13. The shower head of claim 12 wherein said turbine includes a concave socket, with said nozzle post extending into said socket to thereby support said turbine for wobbling and spinning movement.

14. The shower head of claim 7 wherein said turbine extends into and is movable relative to said spin inducing member.

15. The shower head of claim 14 wherein said spin inducing member limits the range of wobble of said turbine.

16. The shower head of claim 15 wherein said nozzle includes a post, said post extending into said spin inducing member and supporting said turbine.

17. The shower head of claim 16 wherein said nozzle water conduit extends through said post.

18. The shower head of claim 17 wherein said nozzle, spin inducing member, and turbine are coaxially positioned, one to another.

19. The shower head of claim 1 wherein said housing includes a spin chamber, said spin inducing member being located therein, said spin water passage including a plurality of partial tangential openings into said spin chamber.

20. The shower head of claim 19 wherein said spin inducing member includes a plurality of outwardly extending blades positioned to receive water from said openings.

21. The shower head of claim 20 wherein said spin inducing member blades are concave and positioned to catch water from said partial tangential openings to cause said spin inducing member to rotate.

22. The shower head of claim 21 wherein said spin inducing member blades are non-radial.

23. The shower head of claim 20 wherein said spin inducing member includes a plurality of windows wherein water from said partial tangential openings, after contacting said blades, passes through said windows and into said nozzle conduit.

24. The shower head of claim 23 wherein said blades are curved at the upper end thereof.

25. The shower head of claim 23 wherein said windows are separated by posts, said posts having a curvature directing the water inwardly towards the nozzle conduit.

26. The shower head of claim 25 wherein said nozzle includes a post, said nozzle post extending into said spin inducing number, with said nozzle conduit being located within said nozzle post.

27. The shower head of claim 1 further including an auxiliary port in said housing, and a passage between said housing inlet and said auxiliary port.

28. The shower head of claim 1 wherein said nozzle includes a diverging cone having a plurality of water openings, and a tube forming said conduit and connected to said diverging cone.

29. The shower head of claim 28 wherein the combined cross sectional area of said diverging cone plurality of water openings is greater than the cross sectional area of said conduit.

30. The shower head of claim 29 wherein said plurality of diverging cone water openings include a single center opening and peripheral openings arranged thereabout.

31. The shower head of claim 30 wherein said peripherally arranged openings diverge outwardly from said center opening.

32. The shower head of claim 28 wherein said tube extends into said spin inducing member, and said wobble inducing member extends within said spin inducing member.

33. The shower head of claim 28 wherein said tube is fixed to said spin inducing member, with said wobble inducing member causing wobble movement in both said spin inducing member and said nozzle, means on said housing for limiting wobble movement of said spin inducing member and for limiting wobble movement of said nozzle.

34. The shower head of claim 33 wherein the ratio of the means limiting wobble movement of said spin inducing member to the exterior of said spin inducing member is the same as the ratio of the means limiting wobble movement of said tube to the exterior of said tube.

35. The shower head of claim 1 wherein said spray openings are radially outside of said nozzle.

36. The shower head of claim 35 wherein said spray openings extend partially circumferentially about said housing.

37. The shower head of claim 36 wherein said spray openings are located in two circumferential rows, an inner row and an outer row.

38. The shower head of claim 37 wherein each spray opening has an axis, with the spray openings in the inner row having a tapered cone-shaped wall, with water passing through said inner row openings along the axis of said cone.

39. The shower head of claim 37 wherein the outer row spray openings each has an asymmetrical tapered wall which directs the spray therefrom outwardly of the spray opening axis.

40. The shower head of claim 35 wherein said spray opening water passage includes a peripherally extending trough in communication with said spray openings.

41. The shower head of claim 1 wherein said housing inlet includes a filter.

42. The shower head of claim 41 wherein said housing inlet includes a flow restrictor downstream of said filter.

43. The shower head of claim 42 wherein said housing includes an auxiliary port, said auxiliary port being upstream of said flow restrictor and downstream of said filter.

44. A shower head including a housing, a water inlet in said housing, a plurality of peripherally arranged spray openings in said housing, a spray opening water passage between said housing water inlet and said spray openings, a spray nozzle on said housing having a plurality of outlets and a water conduit connected thereto, a wobble inducing member in said housing and associated with said nozzle to impart a wobbling motion thereto, a wobble water passage between said housing water inlet and said wobble inducing member whereby water flowing to said wobble inducing member causes it to wobble and to induce wobble in said nozzle, said wobble water passage communicating with said nozzle conduit to supply water to said nozzle outlets, and a spin inducing member in said housing and associated with said nozzle to impart a spin motion thereto, a spin water passage between said housing water inlet and said spin inducing member whereby water flowing to said spin inducing member causes it to spin and to induce spin in said nozzle, said spin water passage communicating with said nozzle conduit to supply water to said nozzle outlets.

45. The shower head of claim 44 further including valve means in said housing controlling the flow of water from said housing inlet to said water passages to provide for selective use of said spray openings, wobble inducing member and spin inducing member.

46. The shower head of claim 45 wherein said valve means provides for the flow of water to said water passages for simultaneous water flow to said openings and to said nozzle.

47. The shower head of claim 45 further including a manual selection member located on the exterior of said housing, and a linkage between said manual selection member and said valve means.

48. The shower head of claim 44 wherein said nozzle is fixed to said spin inducing member, and said wobble inducing member is supported on said spin inducing member.

49. A shower head including a housing, a water inlet in said housing, a control valve in said housing having a water inlet and a plurality of water outlets, a water passage between said housing inlet and said control valve inlet, a plurality of peripherally arranged spray openings in said housing, a spray opening water passage between one of said control valve outlets and said spray openings, a spray nozzle on said housing having a plurality of outlets and a water conduit connected thereto, a wobble inducing member in said housing and associated with said nozzle to impart a wobbling motion thereto, a wobble water passage between another one of said valve outlets and said wobble inducing member whereby water passing from said control valve to said wobble inducing member causes it to wobble and to induce wobble in said nozzle, said wobble water passage being connected to said nozzle conduit to supply water to said nozzle outlets, said control valve being movable between positions to direct water from said control valve inlet to said control valve outlets.

50. The shower head of claim 49 further including a spin inducing member in said housing and associated with said nozzle to impart a spin motion thereto, a spin water passage between yet another one of said valve outlets and said spin inducing member whereby water passing from said control valve to said spin inducing member causes it to spin and to induce spin in said nozzle, said spin water passage being connected to said nozzle conduit to supply water to said nozzle outlets, said wobble inducing member being supported in said housing on said spin inducing member.

51. A shower head including a housing, a water inlet in said housing, a control valve in said housing having a water inlet and a plurality of water outlets, a water passage between said housing inlet and said control valve inlet, a plurality of stationary, peripherally arranged spray openings in said housing, a spray opening water passage between one of said control valve outlets and said spray openings, a nozzle on said housing having a plurality of outlets and a water conduit connected thereto, a spin inducing member in said housing and associated with said nozzle to impart a spin motion thereto, a spin water passage between another one of said valve outlets and said spin inducing member whereby water passing from said control valve to said spin inducing member causes it to spin and to induce spin in said nozzle, said spin water passage being connected to said nozzle conduit to supply water to said nozzle outlets, said control valve being movable between positions to direct water from said control valve inlet to said control valve outlets.

52. The shower head of claim 51 further including a wobble inducing member in said housing and associated with said nozzle to impart a wobbling motion thereto, a wobble water passage between yet another one of said valve outlets and said wobble inducing member whereby water passing from said control valve to said wobble inducing member causes it to wobble and to induce wobble in said nozzle, said wobble water passage being connected to said nozzle conduit to supply water to said nozzle outlets.

53. The shower head of claim 52 wherein said wobble inducing member has a plurality of blades, positioned to receive water from said wobble water passage whereby the water directed to said blades causes said wobble inducing member to wobble.

54. The shower head of claim 51 wherein said spin inducing member has a plurality of curved blades positioned to catch water from said spin water passage to cause rotation of said spin inducing member.

* * * * *